United States Patent [19]

Darragh

[11] Patent Number: 5,060,721

[45] Date of Patent: Oct. 29, 1991

[54] CIRCULAR HEAT EXCHANGER

[75] Inventor: Charles T. Darragh, San Diego, Calif.

[73] Assignee: Solar Turbines Incorporated, San Diego, Calif.

[21] Appl. No.: 530,960

[22] Filed: May 29, 1990

[51] Int. Cl.[5] ..... F28D 7/16; F28F 3/08; F28F 9/22

[52] U.S. Cl. ..... 165/165; 165/166; 165/145

[58] Field of Search ..... 165/145, 165, 166; 60/39.5, 39.511

[56] References Cited

U.S. PATENT DOCUMENTS

| | | | |
|---|---|---|---|
| 3,255,818 | 6/1966 | Beam, Jr. et al. | 165/166 |
| 3,285,326 | 11/1966 | Wosika | 165/4 |
| 3,476,174 | 11/1969 | Guernsey et al. | 165/9 |
| 3,507,115 | 4/1970 | Wisoka | 60/39.51 |
| 3,759,323 | 9/1973 | Dawson et al. | 165/166 |
| 3,785,435 | 1/1974 | Stein et al. | 165/166 |
| 3,814,171 | 6/1974 | Nakamura et al. | 165/166 |
| 3,831,374 | 8/1974 | Nicita | 165/166 |
| 3,889,744 | 6/1975 | Hill et al. | 165/165 |
| 4,098,330 | 7/1978 | Flower et al. | 165/166 |
| 4,229,868 | 10/1980 | Kretzinger | 165/166 |
| 4,506,502 | 3/1985 | Shapiro | 60/39.43 |

FOREIGN PATENT DOCUMENTS

| | | | |
|---|---|---|---|
| 641574 | 5/1962 | Canada | 165/165 |
| 3001568 | 7/1961 | Fed. Rep. of Germany | 165/166 |
| 86594 | 5/1986 | Japan | 165/166 |
| 86596 | 5/1986 | Japan | 165/166 |
| 843965 | 8/1960 | United Kingdom | 165/166 |

*Primary Examiner*—John Rivell
*Assistant Examiner*—L. R. Leo
*Attorney, Agent, or Firm*—Larry G. Cain

[57] ABSTRACT

Circular heat exchangers have been used to increase the efficiency of engines by absorbing heat from the exhaust gases and transferring a portion of the exhaust heat to the intake air. The present heat exchanger is built-up from a plurality of preformed involute curved cells stacked in a circular array to provide flow passages and for the donor fluid and the recipient fluid respectively. The stacked cells are welded along a portion of their edges to secure them in the stacked circular array. Each of the cells have a plurality of corners with the core presenting corresponding corners after the cells are welded together. In order to reinforce the core against thermal stresses and forces generated by pressures of the fluids, circumferential welds are provided at each of the corners.

5 Claims, 4 Drawing Sheets

190
14
194
3
42
180
16
198
38
182
82
64
50
192
3
40
20
184
18
29
20
12
196
40
64
27
24
26
188
138
80
38
16
60
72
42
28
22
62
74
44

CIRCULAR HEAT EXCHANGER

TECHNICAL FIELD

This invention relates generally to a heat exchanger and more particularly to the construction of a heat exchanger having a circular configuration.

BACKGROUND ART

Many gas turbine engines use a heat exchanger or recuperator to increase the operating efficiency of the engine by extracting heat from the exhaust gas and preheating the intake air. Typically, a recuperator for a gas turbine engine must be capable of operating at temperatures of between about 500° C. and 700° C. internal pressures of between approximately 450 kPa and 1400 kPa under operating conditions involving repeated starting and stopping cycles.

Such circular recuperators include a core which is commonly constructed of a plurality of relatively thin flat sheets having an angled or corrugated spacer fixedly attached therebetween. The sheets are joined into cells and sealed at opposite sides and form passages between the sheets. These cells are stacked or rolled and form alternative air cells and hot exhaust cells. Compressed discharged air from a compressor of the engine passes through the air cells while hot exhaust gas flows through alternate cells. The exhaust gas heats the sheets and the spacers and the compressor discharged air is heated by conduction from the sheets and spacers.

An example of such a recuperator is disclosed in U.S. Pat. No. 3,285,326 issued to L. R. Wosika on Nov. 15, 1966. In such a system, the recuperator includes a pair of relatively thin flat plates spaced from an axis and wound about the axis with a corrugated spacer therebetween. The air flow enters one end and exits the opposite end, and the exhaust flow is counter-flow to the air flow entering and exiting at the respective opposite ends.

Another example of such a recuperator is disclosed in U.S. Pat. No. 3,507,115 issued to L. R. Wosika on July 28, 1967. In such a system, the recuperator comprises a hollow cylindrical inner shell and a concentric outer shell separated by a convoluted separator sheet which is wound over and around several corrugated sheets forming a series of corrugated air cores and combustion gas cores. In order to increase the transfer between the hot gases or cold air, the corrugated sheets are metallically bonded to the separator sheets in an attempt to increase efficiency. One of the problems with such a system is its lack of efficiency and the ability to test or inspect individual passages prior to assembly into a finished heat exchanger. Furthermore, the concentric outer shell is exposed to the recuperator temperatures on one side and to the environmental temperature on the other side. Thus, as the recuperator expands and contracts due to start up and shut down, the thermal stress and strain induced in the core at the point of connection between the convoluted separator sheets, the corrugated sheets and the concentric outer shell will be greatly varied and reduce the longevity of the structure.

Another example of such a recuperator is disclosed in U.S. Pat. No. 3,255,818 issued to Paul E. Beam, Jr et al, on June 14, 1966. In such a system, a simple plate construction includes an inner cylindrical casing and an outer annular casing having a common axis. Radially disposed plates form passages A and B which alternately flow a cooler fluid and a hotter fluid. A corrugated plate being progressively narrower in width toward the heat exchanger axis is positioned in the passage A, and a corrugated plate being progressively increasing in width toward the axis is positioned in the passage B. One of the problems with such a system is its lack of efficiency. Furthermore, the outer annular casing is exposed to the recuperator temperatures on one side and to the environmental temperature on the other side. Thus, as the recuperator expands and contracts due to start up and shut down, the thermal stress and strain induced in the core at the point of connection between the radially disposed plates and the outer casing will be greatly varied and reduce the longevity of the structure.

Another example of a circular recuperator or regenerator is disclosed in U.S. Pat. No. 3,476,174 issued to R. W. Guernsey et al, on Nov. 4, 1969. In such system, a radial flow regenerator includes a plurality of heat transfer segments formed by a number of laid-up thin corrugated sheet metal strips or shims. The segments are mounted between stiffeners, and a bridge is positioned in notches and secured to the segments. Thus, the regenerator, while providing a radial flow, fails to efficiently make use of the entire heat exchange area. For example, the stiffeners and bridges are positioned in an area which could be used for heat transferring purposes. Furthermore, the cost and complexity of the structure is greatly increased because of the notches and complex shapes of the control beams.

Another example of a heat exchanger construction is disclosed in U.S. Pat. No. 3,759,323 issued to Harry J. Dawson et al, on Sept. 18, 1973. A primary surface plate-type heat exchanger construction is shown and uses a plurality of flat successively stacked sheets having a plurality of edge bars for spacing the sheets apart. A large number of sheets are stacked in pairs with the edge bars therebetween to form a heat exchange core of a desired size.

The present invention is directed to overcome one or more of the problems as set forth above.

DISCLOSURE OF THE INVENTION

In one aspect of the invention, a heat exchanger includes a core having a plurality of heat recipient passages and a plurality of heat donor passages therein. The core is generally circular shaped and includes a plurality of stacked individual cells. The cells define one of the passages and the adjacent cells being secured together form the other of the passages therebetween. Each of the cells includes a center portion having a pair of sides and a pair of wing portions being attached to the center portion at the pair of sides. Each of the cells have a plurality of corners and a securing means fixedly secures corresponding ones of the corners together.

BEST MODE FOR CARRYING OUT THE INVENTION

Figure 1:
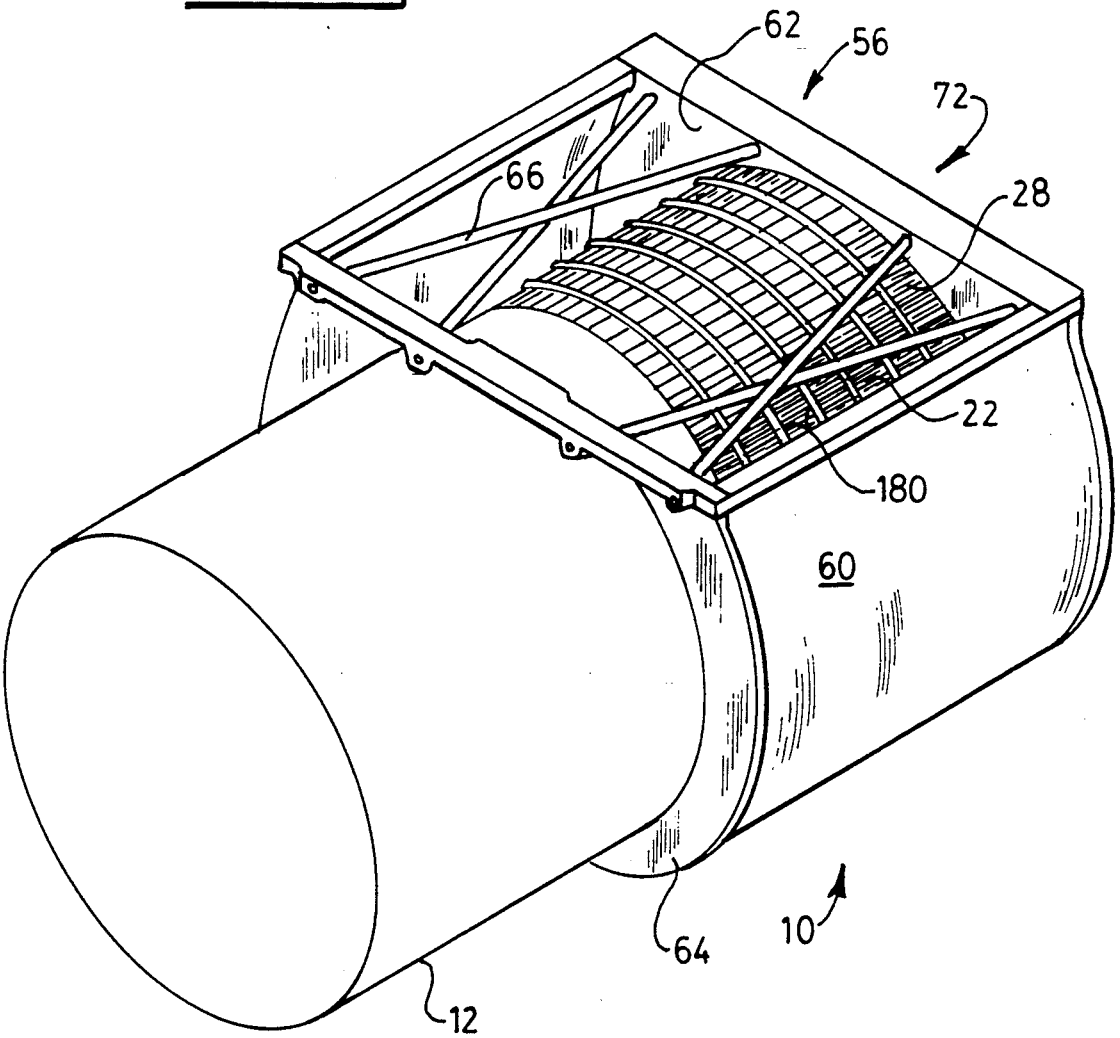
FIG. 1 is a perspective view of an embodiment of the present invention adapted for use with an engine.
Figure 2:
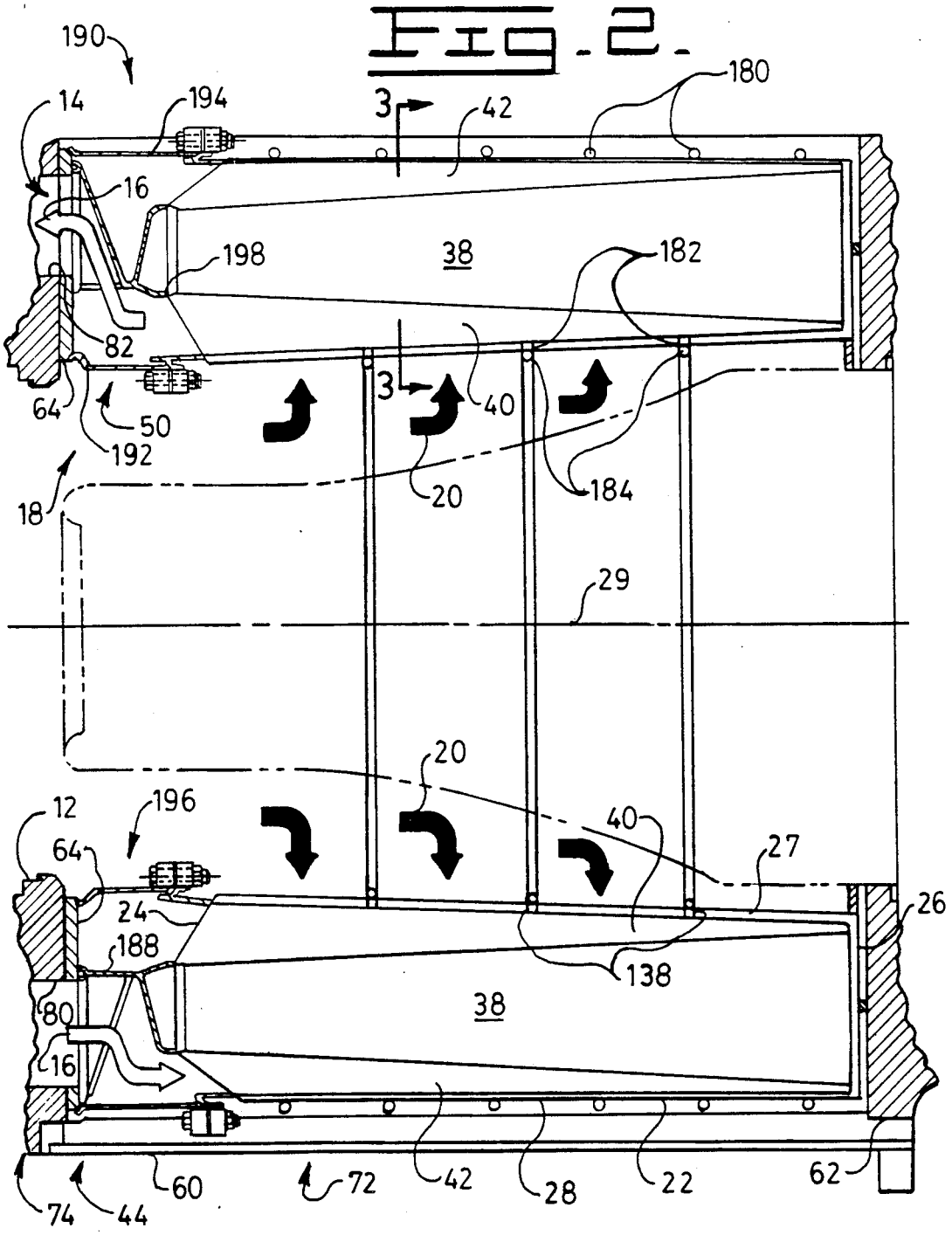
FIG. 2 is a sectional view of a heat exchanger and a portion of the engine.
Figure 3:
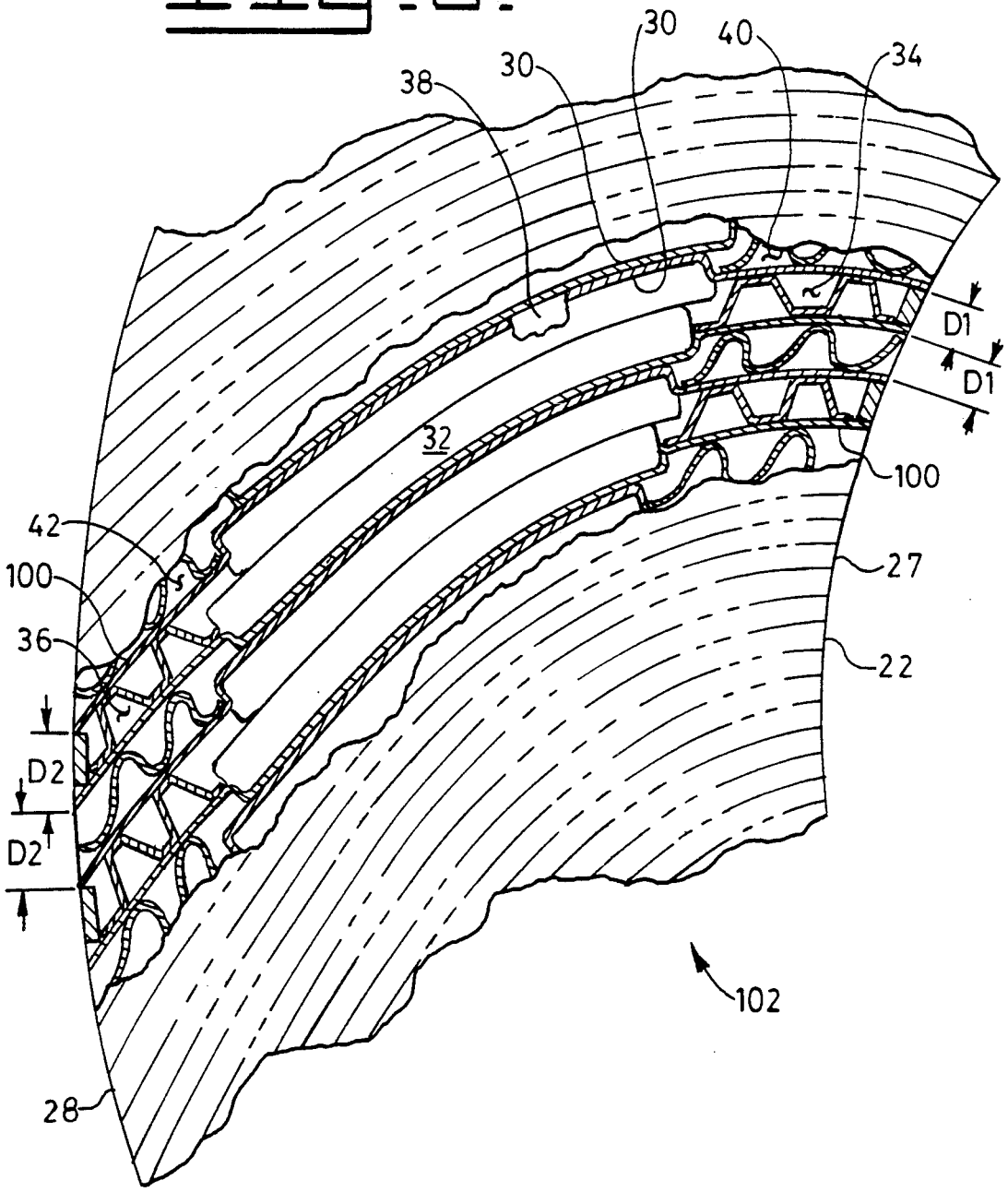
FIG. 3 is an enlarged sectional view through a plurality of cells taken along line 3—3 of FIG. 2.

Referring to the drawings, specifically FIGS. 1, 2 and 3, a heat exchanger or recuperator 10 is attached to an engine 12. The engine 12 in this application is a gas turbine engine including an air intake system 14, only partially shown, having a recipient fluid, designated by the arrow 16, having a preestablished temperature range as a part thereof. The engine 12 further includes an exhaust system 18, only partially shown, having a donor fluid, designated by the arrow 20, having a preestablished temperature range as a part thereof. The temperature range of the recipient fluid 16 is lower than the preestablished temperature of the donor fluid 20. As an alternative, the heat exchanger 10 could be used with any device having the recipient fluid 16 and the donor fluid 20 and in which heat transfer is desirable. The heat exchanger 10 includes a core 22 being made of many pieces, having a preestablished rate of thermal expansion and being generally circular in shape. The core has an end 24, an end 26, an inner portion 27 and an outer portion 28. The heat exchanger 10 could be fixedly attached to the engine 12 without changing the gist of the invention. The core 22 is generally centered about a central axis 29. The core 22 is made up of a plurality of primary surface cells 30 having a first passage or heat recipient or heat recovery passage 32 therein, as best shown in FIG. 3. The passages 32 each have a preestablished transverse cross-sectional area throughout its entire length. The preestablished transverse cross-sectional area includes a preestablished thickness. The core 22 further includes a recipient inlet passage 36 positioned in each of the cells 30 and in fluid communication with corresponding passages 32 for the recipient fluid 16 to pass therethrough prior to entering the passages 32. The core 22 further includes a recipient outlet passage 34 positioned in each of the cells 30 and in fluid communication with corresponding passages 32 for the recipient fluid 16 to pass therethrough after passing through the passages 32. A plurality of second passages or heat donor passages 38 are formed between adjacent cells 30, as best shown in FIG. 3 and will be further defined later in the specification. The core 22 further includes a plurality of donor inlet passages 40 generally positioned inwardly of the heat recipient passages 32 and in fluid communication with individual passages 38 for the donor fluid 20 to pass therethrough prior to entering the passages 38. A plurality of donor outlet passages 42 are further included and are generally positioned outwardly of the heat recipient passages 32 and in fluid communication with individual passages 38 for the donor fluid 20 to pass therethrough after passing through the passages 38. The heat recipient passages 32 are connected to the air intake system 14 and the heat donor passages 38 are connected to the exhaust system 18.

The heat exchanger 10 further includes means 44 for distributing the recipient fluid 16 into the inlet passages 36. The heat exchanger 10 further includes means 50 for collecting the recipient fluid 16 after passing through the outlet passages 34. The heat exchanger 10 further includes a housing 56 partially surrounding the core 22. The housing 56 includes a generally cylindrical wrapper plate 60, an end plate 62 and a mounting adapter 64 for attaching to the engine 12. As an alternative, the mounting adapter 64 or the entire housing 56 could be a part of the engine 12. A plurality of tie bolts 66 interconnect the end plate 62 and the mounting plate 64 adding further rigidity to the housing 56.

Figure 5:
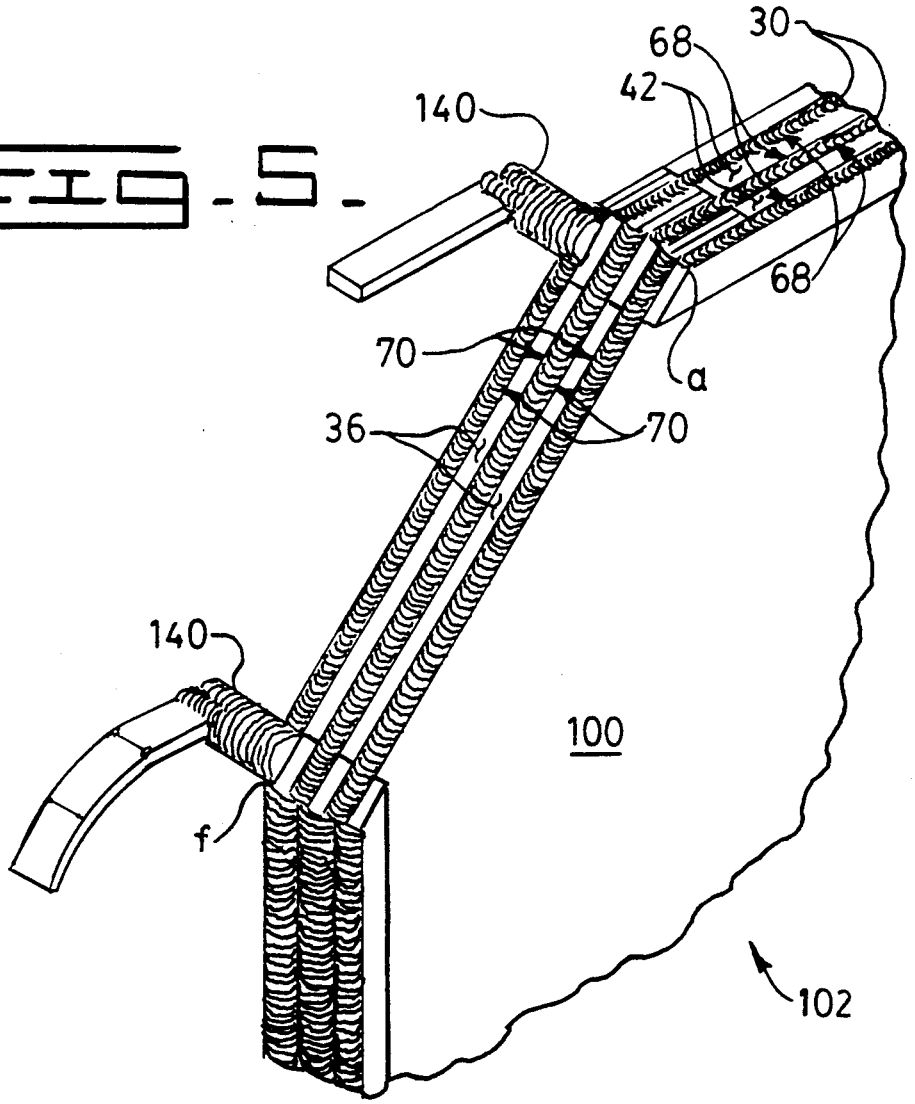
FIG. 5 is a detailed view of a portion of a core showing a portion of the weld thereon.

During operation, the donor fluid 20 passes through the inlet passages 40, heat donor passages 38 and the outlet passages 42 exerting a first working pressure or force, as designated by the arrows 68 as best shown in FIG. 5, in the passages 40, 38, 42 and the recipient fluid 16 passes through the inlet passages 36, heat recipient passages 32 and outlet passages 34 exerting a second working pressure or force, as designated by the arrows 70 as best shown in FIG. 5, in the passages 34, 32, 36. The first and second working pressures 68, 70 have different magnitudes of pressure resulting in a combination of forces attempting to separate the cells 30. The heat exchanger 10 further includes a means 72 for resisting the forces attempting to separate the cells 30 and a means 74 for sealing the donor fluid 20 and the recipient fluid 16. The sealing means 74 insures that the donor fluid 20 passes through the core 22 and seals the recipient fluid 16 prior to entering the core 22 and after passing through the core 22. At least a portion of the means 72 for resisting has a preestablished rate of thermal expansion and responds to the temperature of only the hotter of the fluids 16, 20 and maintains a preestablished force on the heat exchanger 10.

The gas turbine engine 12, which is only partially shown in FIGS. 1 and 2, is of a conventional design. The engine 12 includes a compressor section (not shown) through which cleaned atmospheric air, or in this application the recipient fluid 16, passes prior to entering the core 22. Further included in the engine is a power turbine section (not shown) and the exhaust system 18, only partially shown, through which hot exhaust gasses pass.

The air intake system 14, only partially shown in FIG. 2, of the engine 12 further includes a plurality of inlet ports 80 and a plurality of outlet ports 82 therein through which the recipient fluid 16 passes.

Figure 4:
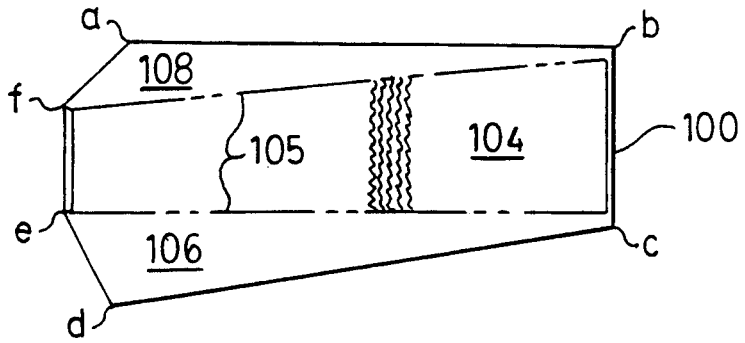
FIG. 4 is a development view of a primary surface pleated sheet showing a plurality of corners on the sheet and corresponding to the plurality of corners of the core.

As best shown in FIG. 3 and 5 the core 22 includes the plurality of primary surface cells 30 stacked and secured together. The cells 30 include a plurality of individual primary surface pleated sheets 100 and means 102 for spacing the sheets 100 a preestablished distance apart. The sheets 100 and the spacing means 102 are positioned in the fixture and as the fixture is closed bends the sheets 100 and the spacing means 102 into their appropriate involute shape. As an alternative, the sheets 100 and the spacing means 102 could be preformed into appropriate involute shapes prior to being placed into the fixture and being attached together. Each sheet 100 contains three principal regions. For example, a corrugated or primary surface center portion 104 has a pair of sides 105, as best shown in FIG. 4. The center portion 104 has a generally trapezoidal shape. Each sheet further has a wing portion 106 and a wing portion 108 each having a generally trapezoidal shape. A plurality of spacer bars 138 are further included in the spacer means 102 and have a preestablished thickness. In this particular application the bars 138 are positioned only at the inner portion 27 of the core 22. The individual sheets 100 and the spacing means 102 are secured in their appropriate involute configuration.

As best shown in FIG. 4, each of the cells 30 have a plurality of corners designated by a, b, c, d, e and f. The corresponding corners a, b, c, d, e, and f of each cell 30 are aligned, stacked in contact with another one of the cells 30 and placed in side-by-side contacting relationship to the corresponding wing portions 106 and 108. A means 120 for securing, as best shown in FIG. 5, the stacked cells 30 along a portion of their edges in the stacked circular array retains the cells 30 and form the core 22. Each of the cells 30 have a plurality of corners with the core 22 presenting corresponding corners after the cells 30 are welded together. As best shown in FIGS. 3 and 5, a portion of the outer peripheries of successive cells 30 are joined together to form the inlet passages 40, the heat donor passages 38 and the outlet passages 42.

In this specific application, the means 72 for resisting the forces attempting to separate the cells 30 and the passages 40, 38, 42 therebetween includes the securing means 120 which in this application is a plurality of circumferential welds 140. The plurality of welds 140 are used to further attach the cells 30 into the core 22. One of the plurality of circumferential weld 140 is used to weld each of the corners a, b, c, d, e and f. The inner portion 27 of the core 22 has a preestablished circumference and the outer portion 28 of the core 22 has a preestablished circumference. The circumference of the inner portion 27 is made up of a plurality of linear distances "D1". Each of the distances "D1" is measured from respective sides of each sheet 100 at the inner portion 27 of the core 22. Due to the involute shape of the cells 30, a distance "D2" being greater than the distance "D1" is measured from respective sides of the end of each sheet 100 at the outer portion 28 of the core 22. The combination or addition of the distances "D1" results in the preestablished circumference of the inner portion 27 and the combination or addition of the distance "D2" results in the preestablished circumference of the outer portion 28 of the core 22.

As best shown in FIGS. 1 and 2, a further portion of the means 72 for resisting the forces attempting to separate the cells 30 and the passage 40, 38, 42 therebetween includes a plurality of evenly spaced individual tension rings 180 positioned around the outer portion 28 of the core 22 and a plurality of welds 182 circumferentially connecting aligned spacer bars 138 at the inner portion 27 of the core 22. The plurality of tension rings 180 have a rate of expansion and contraction which is substantially equal to the expansion rate of the core 22. The plurality of circumferential welds 182 and the spacer bars 138 form a plurality of compressive hoops 184. The hoops 184 are evenly spaced along the core 22 and enable each of the cells 30 to be in force transferring relationship to each other.

As best shown in FIGS. 2, a portion of the means 74 for sealing includes a manifold 188 which is positioned between the cooler recipient fluid 16 prior to entering the core 22 and the heated recipient fluid 16 after exiting the core 22. An apparatus 190 for surrounding the recipient fluid 16 is also included and has an inner portion 192 and an outer portion 194 which act as a basing means 196 for holding one end of the core 22 in contact with the end plate 64 of the housing 56. The manifold 188 has an end 198 fixedly attached to the core 22 and the other end removably attachable in sealing contact with the mounting adapter 64.

As best shown in FIG. 2, the means 74 for sealing further has a portion thereof adapted to seal the exhaust system 18 so that the donor fluid 20 passes through the core 22.

Industrial Applicability

The compressor section of the conventional gas turbine engine !2 compresses atmospheric air or recipient fluid 16 which is then passed through the heat recipient passages 32 of the heat exchanger 10. Exhaust gases or donor fluid 20 from the combustion in the engine 12 pass through the heat donor passages 38 of the heat exchanger 10 and thermally heats the recipient fluid 16 in the heat exchanger 10. The recipient fluid is then mixed with fuel, combusted and exhausted as the donor fluid 20. Thus, during operation of the engine 12 a continuous cycle occurs.

Especially when the engine 12 is used in fluctuating load conditions, such as vehicular or marine applications, the cyclic operation of the engine 12 causes the exhaust gas temperature to increase and decrease. Furthermore the intake air and the exhaust gas volume and pressure varies depending on the the cyclic operation. Thus, the structural integrity of the heat exchanger components are stressed to the ultimate. The circumferential welds 140 at each of the corners a, b, c, d, e and f hold the corners of the individual cells 30 and the core 22 together while resisting the tensile stresses and loads from expansion due to increased temperature and volume. Theoretical analysis has shown that without the plurality of circumferential welds 140 the structural integrity of the core 22 would not be able to resist the thermal and load variations. The plurality of tension rings 180 expand and contract at substantially the same rate as the core 22. Thus, during the cyclic operation of the engine 12, the plurality of tension rings 180 hold the core 22 together at the outer portion 28 between the ends 24, 26. The compressive hoops 184 at the inner portion 27 of the core 22 resist the forces at the inner portion 27.

In view of the foregoing, it is readily apparent that the structure of the present invention provides an improved circular heat exchanger structure. The plurality of individual welds 140 at each of the corners provides structural integrity to resist the forces attempting to separate the core 22. The welding process is simple and economical. Thus, the plurality of individual circumferential welds 140 provides a system that increases the longevity and decreases the cost of making circular heat exchangers 10.

Other aspects, objects, and advantages of this invention can be obtained from a study of the drawings, the disclosure and the appended claims.

I claim:

1. A heat exchanger including a core having a plurality of heat recipient passages and a plurality of heat donor passages therein, comprising:

said core being generally circularly shaped including a plurality of stacked individual cells including a plurality of individual primary surface pleated sheets and means for spacing the sheets a preestablished distance apart are secured together, each of said cells defining one of the passages therein, the cells being secured together and adjacent cells forming the other of the passages therebetween;

each of said cells includes a center portion having a pair of sides and a pair of wing portions being attached to the center portion at the pair of sides; and each of said cells having a plurality of corners and securing means fixedly secures at least corresponding ones of said corners of adjacent pairs of cells together.

2. The heat exchanger of claim 1 wherein said core further includes an inner portion and an outer portion and said securing means includes a single circumferential weld at corresponding corners of adjacent pairs of cells along the inner portion of the core.

3. The heat exchanger of claim 2 wherein said securing means includes a single circumferential weld at corresponding corners of adjacent pairs of cell along the outer portion of the core.

4. The heat exchanger of claim 2 wherein said core includes a pair of ends and said securing means includes a pair of circumferential welds located between the inner and outer portions of the core.

5. The heat exchanger of claim 1 wherein said securing means includes a circumferential weld therearound at each of said corners of adjacent pairs of cells securing the cells together.

* * * * *

UNITED STATES PATENT AND TRADEMARK OFFICE

CERTIFICATE OF CORRECTION

PATENT NO. : 5,060,721

DATED : October 29, 1991

INVENTOR(S) : Charles T. Darragh

It is certified that error appears in the above-identified patent and that said Letters Patent is hereby corrected as shown below:

Claim 3, Column 7, line 8, "cell" should be --cells--

Signed and Sealed this

Twenty-third Day of March, 1993

*Attest:*

STEPHEN G. KUNIN

*Attesting Officer*

*Acting Commissioner of Patents and Trademarks*